US008167226B2

(12) United States Patent
Engnell

(10) Patent No.: US 8,167,226 B2
(45) Date of Patent: May 1, 2012

(54) CHIPPER KNIFE AND METHOD OF MANUFACTURING A CHIPPER KNIFE

(75) Inventor: Mats Engnell, Iggesund (SE)

(73) Assignee: Iggesund Tools AB, Iggesund (SE)

( * ) Notice: Subject to any disclaimer, the term of this patent is extended or adjusted under 35 U.S.C. 154(b) by 0 days.

(21) Appl. No.: 12/522,795

(22) PCT Filed: Jan. 8, 2008

(86) PCT No.: PCT/SE2008/000010

§ 371 (c)(1),
(2), (4) Date: Jan. 12, 2010

(87) PCT Pub. No.: WO2008/085111

PCT Pub. Date: Jul. 17, 2008

(65) Prior Publication Data

US 2010/0123034 A1 May 20, 2010

(30) Foreign Application Priority Data

Jan. 12, 2007 (SE) ..... 0700048

(51) Int. Cl.
*B02C 18/18* (2006.01)

(52) U.S. Cl. ..... 241/294; 241/92

(58) Field of Classification Search ..... 241/294, 241/296, 298, 278.1, 92; 144/241, 220, 230
See application file for complete search history.

(56) References Cited

U.S. PATENT DOCUMENTS

| | | | | |
|---|---|---|---|---|
| 2,747,803 | A * | 5/1956 | Hanse | 241/191 |
| 3,321,145 | A * | 5/1967 | Gorman | 241/189.1 |
| 4,998,574 | A * | 3/1991 | Beach et al. | 144/241 |
| 5,564,967 | A | 10/1996 | Jorgensen | |
| 6,523,768 | B2 * | 2/2003 | Recker et al. | 241/294 |

FOREIGN PATENT DOCUMENTS

EP 1329295 A2 7/2003

* cited by examiner

*Primary Examiner* — Faye Francis
(74) *Attorney, Agent, or Firm* — Fitzpatrick, Cella, Harper & Scinto

(57) ABSTRACT

A chipper knife adapted to be mounted in chippers which have a rotatable tool, in the form of a disc, drum or frusto-conical member, on which a plurality of chipper knives are mounted has at least one cutting edge which is defined between two edge-forming surface portions of the knife at an acute angle to each other. At least one of the two edge-forming surface portions extends from the cutting edge inwardly to a shoulder extending parallel to and facing away from the cutting edge and defining a step surface on the knife behind the shoulder with respect to the rest of the adjacent knife surface and chipper knife.

7 Claims, 2 Drawing Sheets

CHIPPER KNIFE AND METHOD OF MANUFACTURING A CHIPPER KNIFE

The present invention relates to a chipper knife of the type that is adapted to be mounted in chippers which have a rotatable tool, in the form of a disc, drum or frustoconical member, on which are mounted a plurality of such chipper knives to provide, during rotation of the tool and simultaneous feeding of pieces of wood or timber to the same, material-cutting working or disintegrating of the pieces of wood into chips, comprising at least one cutting edge which is defined between two edge-forming surfaces at an acute angle to each other.

The invention also relates to a method of manufacturing such a chipper knife.

BACKGROUND ART

In the production of chips from wood raw material, chippers of the above described type are used. Such chippers can be of the type that is used in order to chip, from the entire wood raw material, chips for production of paper pulp or production of boards, but can also be "reducers" which are used for forming blocks of round logs and which have on the one hand chipper knives for chipping the material that is to be removed from the logs into chips, and on the other cleaning knives to provide fine working of the block surfaces.

Chippers are operated under highly varying conditions where the hardness of the wood can vary to a great extent depending on type of tree, temperature with the respect to frozen or unfrozen wood, knottiness, fine grain and the like. The hardness and nature of the wood is important to the cutting edge angle which the chipper knives, and the cleaning knives for that matter, should have for optimum operational economy.

Furthermore, there are many different types, makes and sizes of chippers on the market, which may require different chipping geometries, that is geometry of that part of the chipper knife that is directly involved in chipping, that is the cutting edge and the area on both sides next to the cutting edge. The term cutting geometry relates to, inter alia, the cutting edge angle, the angle of the edge-forming surface on the wood side, that is the side oriented toward the pieces of wood arriving at the chipper knives, relative to the direction of motion of the chipper knife and the angle of the edgeforming surface on the chip side, that is the side of the chipper knife where the chips are separated, relative to the direction of motion of the chipper knife. In some cases it may be desirable to change the chipping geometry of the chipper knife in order to control, for instance, the chip size or the chipping power.

Summing up, this means that each type and size of chipper knife has to be manufactured and kept in stock in many variants with different cutting edge angles, different angles of the edge-forming surface on the wood side and/or different angles of the edge-forming surface on the chip side. This results in high costs of manufacture and stock-keeping of the chipper knives.

BRIEF DESCRIPTION OF THE INVENTION

The invention aims at overcoming the above problems and drawbacks of prior art chipper knives and providing a chipper knife which can be manufactured in one or a few basic designs and whose chipping geometry can easily be adjusted to different chippers, kinds of wood, operating conditions and the like. At least this object is achieved by a chipper knife made in accordance with the disclosure of this specification.

The invention also concerns a method of manufacturing a chipper knife with substantially the same object as stated above. Also this object is achieved by a method of manufacturing as described in this specification.

The term chipper knife, as used in the present description and claims, is to include also cleaning knives which do not perform chipping in the actual sense but which are used in chippers of reducer type for material-cutting fine working of block surfaces.

Thus, the invention is based on the knowledge that the above object can be achieved by making a blank for a chipper knife, which blank is formed with a thickened cutting edge portion on at least one of the edge-forming surfaces, the cutting edge portion extending from the cutting edge and a distance rearwards on the chipper knife and is terminated with a stepped shoulder edge toward the rest of the edge-forming surface. In this manner, one single design of a blank for a chipper knife can be made and kept in stock, after which the chipper knife is customised with respect to, for instance, type of chipper, kind of wood, operating conditions and the desired chip thickness by working the thickened cutting edge portion to the desired cutting edge angle and/or the desired angle of the edge-forming surface on the chip side and/or the wood side relative to the direction of motion of the chipper knife in operation.

Within the scope of this general inventive concept, the invention can be accomplished in various ways. In an embodiment of the invention that will be described and shown below, thickened cutting edge portions are arranged on both edge-forming surfaces, but it would be possible to arrange a thickened cutting edge portion on only one side, preferably the chip side. The width of the thickened cutting edge portion is in a preferred embodiment 3-7 mm, preferably 4-6 mm, and the thickness in an unworked state of the blanks about 0.1-0.5 mm or about 0.3 mm. However, these dimensions can be varied within wide limits depending on the size of the chipper knife in question. In general, the thickened cutting edge portion should be given such a width and thickness that the cutting edge angle of the chipper knife can be varied between about 27 and 40°, preferably between about 30 and 37°, but, in addition, the thickened cutting edge portions should be as narrow and thin as possible so that the consumption of material and the extent of working should be as small as possible.

Furthermore, the shown and described chipper knife is of the type reversible knife which is symmetric and has cutting edges along two opposite longitudinal edges in such a manner that the chipper knife can be reversed when one cutting edge is worn out and be placed with the other cutting edge in position for working. However, the chipper knife could also be of a type that has only one cutting edge.

The inventive blanks can be made in various ways, for instance by rolling, cold drawing, powder metallurgy, forging or casting. It is desirable to make the blanks with such great dimensional accuracy that reworking is reduced to a minimum, preferably no reworking at all is necessary, except reworking of the thickened cutting edge portions.

Also the finishing of the thickened cutting edge portions can be carried out in various ways: for instance by grinding using a grinding disc, using a grinding belt, or milling using a milling tool. When using a grinding disc, grinding can be performed by means of the circumferential surface of the disc or by means of a radial surface. In the former case, this means that the thickened cutting edge portion will be slightly concave. In general, finishing should be carried out so that any working stripes of the thickened cutting edge portion will extend at an angle to the cutting edge in order to reduce friction in chipping and prevent fracture-indicating stripes parallel to the cutting edge.

In a preferred embodiment, the blank is made so that both the thickened cutting edge portion and the edge-forming surface a distance further inward on the chipper knife are flat and parallel to each other. In fact, such a design results in great freedom of forming the thickened cutting edge portion at many different angles in the finishing of the cutting edge portion, while at the same time the consumption of material can be kept at a low level. The thickened cutting edge portion of the blank could, however, also be made with a concave or convex shape, as can also the edge-forming surface further inward on the chipper knife. As mentioned above, the thickened cutting edge portion can, in the finishing operation, also be made with a slightly concave shape. This may be advantageous on the chip side since the chips will have a softer transition before hitting the rest of the edge-forming surface and by reduced wear since the chips are guided away from the holder of the chipper knife and the rotating tool. Summing up, this means that a chipper knife according to the invention in a final embodiment will have a thickened cutting edge portion which makes an angle to, or has a centre of curvature different from, the rest of the edge-forming surface.

The invention also concerns a method of allowing regrinding once or several times also of chipper knives that are normally not reground after use when the cutting edge has become worn and dull. This object is achieved by a method according to the disclosure of this specification. With the thickened cutting edge portion, an extra grinding allowance is in fact obtained, which can be used to enable regrinding. In such a case, the chipper knife can be reground either to the same cutting edge angle as before, if sufficient grinding allowance is available on the thickened cutting edge portion, or to a different cutting edge angle, for instance regrinding a chipper knife with a small cutting edge angle to a greater cutting edge angle.

Within the scope of the invention, all types of chipper knives are included, which are used for chipping of wood raw material, on the one hand into chips that are used for paper pulp production and, on the other, into chips that are used for producing fibreboards of different kinds, such as Waferboards or OSB boards. Machines for the latter type of production of chips usually have a rotating drum where the knives are mounted along the inner circumference of the drum and the pieces of wood are supplied to the drum for chipping. The invention also comprises cleaning knives that are used in reducers.

BRIEF DESCRIPTION OF THE DRAWINGS

An exemplified embodiment of the invention will now be described with reference to the accompanying drawings, in which.

DETAILED DESCRIPTION OF AN EMBODIMENT OF THE INVENTION

Figure 1:
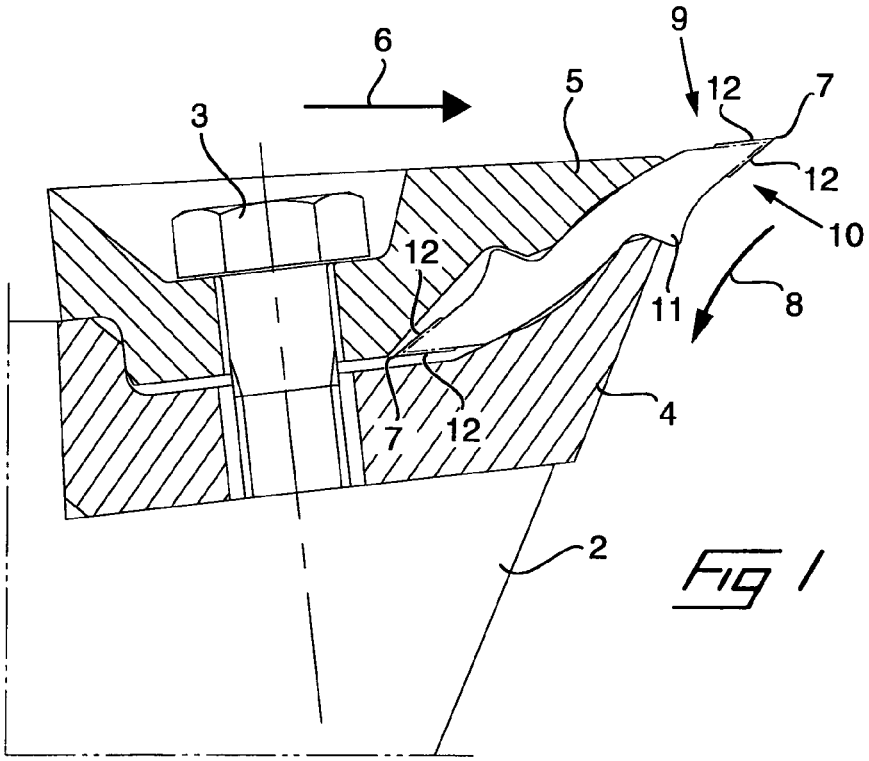
FIG. 1 is a cross-section of part of a chipper disc with a chipper knife according to the invention mounted in a holder.

FIG. 1 illustrates an example of a chipper knife 1 for disintegrating chipping of wood raw material into chips. The shown chipper knife is mounted on a rotating chipper disc 2 and is secured to this by clamping by means of a bolt 3 between an inner and an outer holding part 4 and 5 respectively. The chipper disc 2 is substantially circular and rotates in the figure to the right in the plane of the sheet of paper, that is in the direction of the arrow 6. The chipper disc comprises in a conventional way a number of almost radial through slots, adjacent to the rear edges, seen in the direction of rotation, of which a plurality of chipper knives are mounted in such a manner that cutting edges 7 of the same project over the slot opening. During rotation of the chipper disc 2 and simultaneous feeding of pieces of wood from above in the plane of the sheet of paper, the chipper knives will disintegrate the pieces of wood into chips which are fed in the direction of the arrow 8 through the slots in the chipper discs.

The cutting edge 7 of the chipper knife is formed between edge-forming surfaces at an acute angle to each other and, more specifically, between an edge-forming surface 9 on the wood side, that is on the side toward which the arriving pieces of wood are fed to the chipper, and an edge-forming surface 10 on the chip side, that is the side where the chips are separated. A distance inwards from the cutting edge 7, the chipper knife is provided with a chip-guiding bead 11 which serves to guide the separated chips outward away from the inner holding part 4 and the chipper knife 2 in order to reduce wear on the same.

Figure 2:
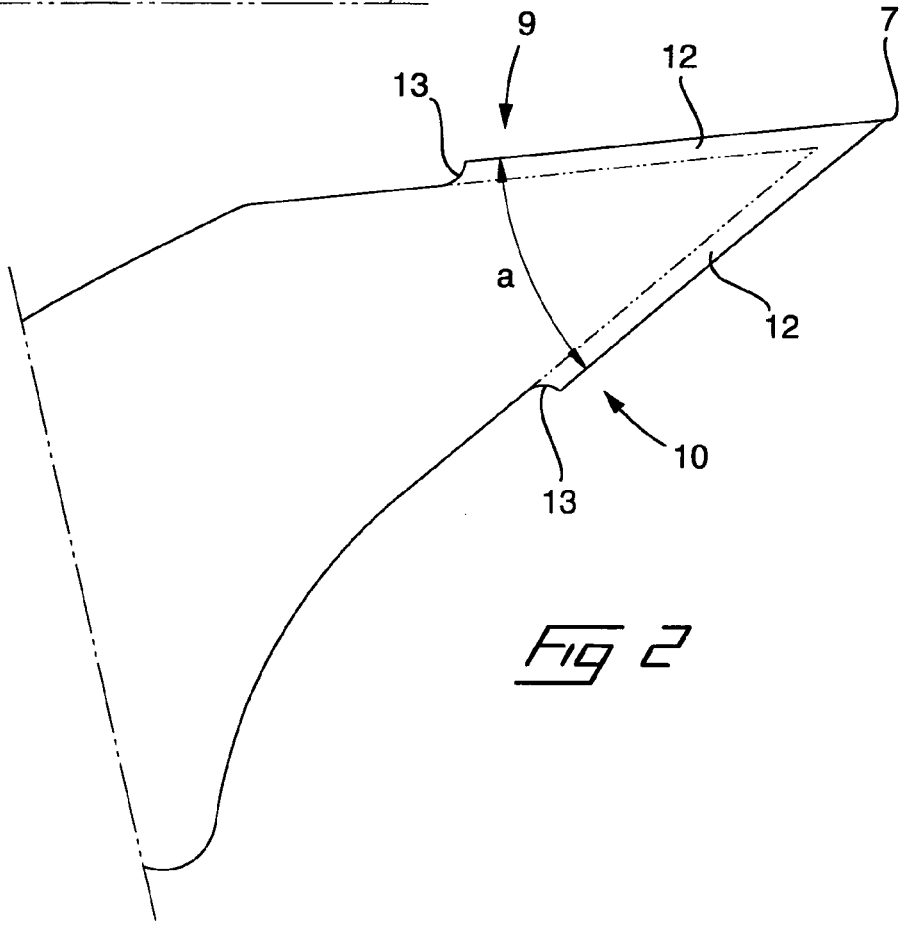
FIG. 2 is an enlarged cross-section of the edge-forming outer part of the chipper knife in FIG. 1 with a first cutting edge angle.

FIG. 2 is an enlarged view of the outermost part of the chipper knife, showing the cutting edge 7, the edge-forming surface 9 on the wood side and the edge-forming surface 10 on the chip side. According to the invention, the edge-forming surfaces 9 and 10 comprise a thickened cutting edge portion 12 in the area next to the cutting edge in such a manner that there is formed a stepped shoulder edge 13 adjoining the rest of each edge-cutting surface. The figure illustrates by dash-dotted lines the imaginary contour of the shape of a conventional chipper knife. In a practical design, the thickened cutting edge portions can be about 4-6 mm wide and about 0.3 mm thick. This is an example of how a blank for a chipper knife can be formed and in this case the cutting edge angle a is about 34°. If the cutting edge angle of the blank is to be maintained in the completed knife, the thickened cutting edge portions can suitably only be polished to obtain a smooth surface with low friction and to remove any working stripes with a small angle to the cutting edge, which help to increase the chipping resistance and, thus, the consumption of power in operation and which can serve as indications of fracture.

Figure 3:
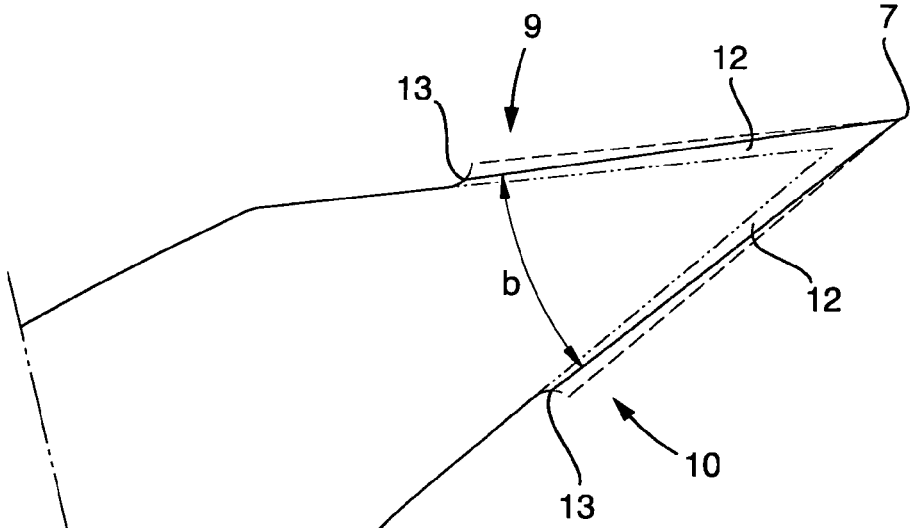
FIG. 3 is a cross-section according to FIG. 2 with a second cutting edge angle.
Figure 4:
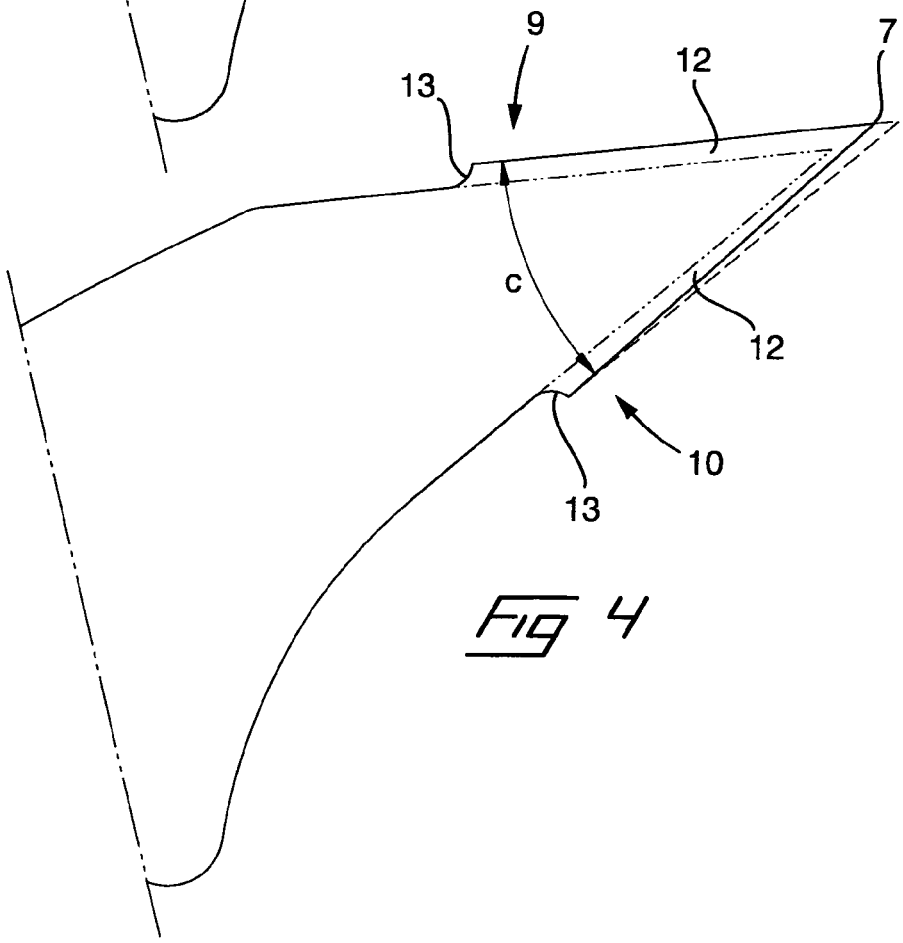
FIG. 4 is a cross-section according to FIGS. 2 and 3 with a third cutting edge angle.

However, if the cutting edge angle of the blank is to be changed, the thickened cutting edge portions can easily be worked to the desired degree, as exemplified in FIGS. 3 and 4. In FIG. 3, the thickened cutting edge portions 12 have been worked so that the formed cutting edge angle b is about 30°. This is achieved by the thickened cutting edge portion 12 on both the wood side 9 and the chip side 10 being worked so that the rear edge of each cutting edge portion has been worked down almost completely by gradually decreasing working toward the cutting edge so that the area adjacent the actual cutting edge 7 is left substantially unworked. The degree of working relative to the blank is shown by dash-dotted lines.

FIG. 4 illustrates an embodiment where the cutting edge angle c has instead been increased to about 36°. This is achieved by the thickened cutting edge portion 12 on the chip side 10 being given such a degree of working in the area of the cutting edge 7 by gradually decreasing working in the direction of the rear area adjacent the stepped shoulder edge 13. However, the thickened cutting edge portion 12 on the wood side has been left substantially unworked. In fact, problems may arise if the angle between the edge-forming surface 9 on the wood side and the direction of motion of the chipper knife decreases since this results in the angle of clearance between the chipper knife and the wood that is chipped into chips decreasing or disappearing completely, which may cause increased friction and an increased temperature in the chipper knife and/or the feeding of the pieces of wood to be disturbed so that the pieces of wood bounce against the chipper knife, resulting in irregular chip sizes.

The embodiments shown in FIGS. 2-4 are only examples of variations that are conceivable within the scope of the invention, and of course many other cutting edge angles are possible. The initial angles of the thickened cutting edge portions relative to each other and to the intended direction of motion of the chipper knife can also be varied in the blank. As mentioned above, it is also possible to maintain the cutting edge angle unchanged, but nevertheless carry out working of both sides, for instance to control the chip size by changing the angle of the chip side to the direction of motion of the chipper knife.

The invention claimed is:

1. A wood chipper knife comprising:

a knife body having first and second opposed side surfaces each of which includes cutting edge portions which intersect at an acute angle to form at least one cutting edge;

the cutting edge surface portion on the first side surface of the knife is formed as a raised edge portion at an area closest to the cutting edge, extends inwardly from the cutting edge, terminates at a shoulder extending parallel to and facing away from the cutting edge and defines a clearance step surface on the knife behind the shoulder with respect to the adjacent portion of the first side surface, said raised edge portion having a surface which is located at an angle to, or has a different radius of curvature from, the portion of the first side surface of the knife inwardly of said clearance step surface.

2. A chipper knife as claimed in claim 1, wherein the cutting edge surface portion on the first side of the knife is flat.

3. A chipper knife as claimed in claim 1 wherein the cutting edge surface portion on the first side of the knife is concave in transverse cross section.

4. A chipper knife as claimed in claims 1, 2 or 3 wherein the cutting edge portion on the second side surface of the knife is formed as a raised edge portion at an area closest to the cutting edge, extends inwardly from the cutting edge, and terminates at a shoulder extending parallel to and facing away from the cutting edge and defining a clearance step surface on the knife behind the shoulder with respect to the adjacent portion of the second side surface and wherein said raised edge portion has a surface which is located at an angle to, or has a different radius of curvature from, the portion of the second side surface of the knife inwardly of said clearance step surface.

5. A chipper knife as defined in claim 4 wherein the cutting edge portions on the first and second side surfaces of the knife each have a width which is 3-7 mm between the cutting edge and the shoulder, preferably 4-6 mm and a maximum thickness which is 0.1-0.5 mm.

6. A chipper knife as claimed in claims 1, 2 or 3 wherein the cutting edge portion on the first side of the knife has a width which between the cutting edge and the shoulder is 3-7 mm, preferably 4-6 mm and a maximum thickness which is 0.1-0.5 mm.

7. A chipper knife as defined in claim 1 wherein said step surface forms an angle to the portion of the first side surface which is inward on the knife from the cutting edge portion.

* * * * *